US011573013B2

(12) United States Patent
Oh et al.

(10) Patent No.: US 11,573,013 B2
(45) Date of Patent: Feb. 7, 2023

(54) AIR GUIDE FOR CEILING-TYPE AIR CONDITIONER AND CEILING-TYPE AIR CONDITIONER HAVING SAME

(71) Applicant: LG ELECTRONICS INC., Seoul (KR)

(72) Inventors: Dongig Oh, Seoul (KR); Beomsoo Seo, Seoul (KR); Joonshik Yoon, Seoul (KR); Bonchang Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 399 days.

(21) Appl. No.: 16/616,576

(22) PCT Filed: May 25, 2018

(86) PCT No.: PCT/KR2018/005990
§ 371 (c)(1),
(2) Date: Nov. 25, 2019

(87) PCT Pub. No.: WO2018/217068
PCT Pub. Date: Nov. 29, 2018

(65) Prior Publication Data

US 2020/0088420 A1 Mar. 19, 2020

(30) Foreign Application Priority Data

May 25, 2017 (KR) ..... 10-2017-0064530

(51) Int. Cl.
*F24F 1/0317* (2019.01)
*F24F 1/028* (2019.01)
(Continued)

(52) U.S. Cl.
CPC ..... *F24F 1/0317* (2019.02); *F24F 1/022* (2013.01); *F24F 1/028* (2019.02); *F24F 13/081* (2013.01);
(Continued)

(58) Field of Classification Search
CPC .... F24F 1/0317; F24F 1/0047; F24F 2221/14; F24F 1/028; F24F 13/081; F24F 13/08
See application file for complete search history.

(56) References Cited

U.S. PATENT DOCUMENTS 4,507,940 A 4/1985 Sato et al.
7,637,128 B2 * 12/2009 Kim ..... F16F 9/3235 188/322.18
(Continued)

FOREIGN PATENT DOCUMENTS

CN 203083029 7/2013
CN 105299756 2/2016
(Continued)

OTHER PUBLICATIONS

Chinese Office Action dated Sep. 2, 2020 issued in Application No. 201880034631.1.
(Continued)

*Primary Examiner* — Lionel Nouketcha
(74) *Attorney, Agent, or Firm* — Ked & Associates

(57) ABSTRACT

An air guide for a ceiling-type air conditioner is applied to the ceiling-type air conditioner comprising: an indoor unit having a heat exchanger and a blower embedded therein, and having a plurality of blowing passages for discharging, to the outside, air which has passed through the heat exchanger; a plurality of inlets for receiving the air discharged through the plurality of blowing passages; and a discharge panel having an inner space, of which at least a portion communicates with the plurality of inlets, and a ring or arc-shaped opening for discharging, into a room, air which has flowed into the inner space. The air guide includes: at least two partition parts formed in parallel to the radial direction of the opening, and dividing the inner space in the circumferential direction; and a curved part connecting the at least two partition parts, and formed in an arc
(Continued)

shape, and is detachably inserted into the inside of the opening from the outside of the opening.

12 Claims, 9 Drawing Sheets

(51) Int. Cl.
*F24F 13/08* (2006.01)
*F24F 13/20* (2006.01)
*F24F 1/022* (2019.01)

(52) U.S. Cl.
CPC ..... *F24F 13/20* (2013.01); *F24F 2013/205* (2013.01)

(56) References Cited

U.S. PATENT DOCUMENTS

| | | | | |
|---|---|---|---|---|
| 2016/0290661 | A1* | 10/2016 | Ogura | F24F 1/0022 |
| 2022/0049858 | A1* | 2/2022 | Kim | F24F 13/20 |

FOREIGN PATENT DOCUMENTS

| | | |
|---|---|---|
| CN | 105737354 | 7/2016 |
| CN | 205991557 | 3/2017 |
| EP | 3 076 099 | 10/2016 |
| GB | 2 102 114 | 1/1983 |
| JP | 2016-070614 | 5/2016 |
| JP | 2016-191490 | 11/2016 |
| KR | 10-2004-0081080 | 9/2004 |
| KR | 10-2007-0060502 | 6/2007 |
| KR | 10-0897425 | 5/2009 |
| KR | 10-2010-0033310 | 3/2010 |
| KR | 20-2012-0001065 | 2/2012 |
| KR | 20-2014-0005108 | 9/2014 |
| KR | 10-1623692 | 5/2016 |
| KR | 10-2017-0048128 | 5/2017 |

OTHER PUBLICATIONS

European Search Report dated Feb. 4, 2021.
International Search Report (with English Translation) and Written Opinion dated Aug. 30, 2018 issued in Application No. PCT/KR2018/005990.
Korean Notice of Allowance dated Aug. 24, 2021.

* cited by examiner

AIR GUIDE FOR CEILING-TYPE AIR CONDITIONER AND CEILING-TYPE AIR CONDITIONER HAVING SAME

CROSS-REFERENCE TO RELATED PATENT APPLICATIONS

This application is a U.S. National Stage Application under 35 U.S.C. § 371 of PCT Application No. PCT/KR2018/005990, filed May 25, 2018, which claims priority to Korean Patent Application Nos. 10-2017-0064530, filed May 25, 2017, whose entire disclosures are hereby incorporated by reference.

TECHNICAL FIELD

The present disclosure relates to an air guide for a ceiling-type air conditioner and a ceiling-type air conditioner having the same.

BACKGROUND ART

An air conditioner is a device that creates a more comfortable indoor environment for a user.

An air conditioner may cool or heat a room by using a refrigerating cycle apparatus including a compressor, a condenser, an expansion mechanism, and an evaporator through which a refrigerant is circulated.

The air conditioner may be classified into a stand type air conditioner, a wall-mounted air conditioner, and a ceiling-type air conditioner according to installation positions.

The ceiling-type air conditioner is installed on the ceiling to discharge cold or warm air into the room.

Recently, ceiling-type air conditioners having a circular shape have been manufactured.

For example, referring to Korean Patent Publication No. 10-0897425, an air conditioner including a front panel having an open portion formed with an intake port through which external air is introduced and a discharge port through which the introduced internal air is discharged and a separating guide provided in the open portion of the front panel and having a ring shape so that the intake port is located on an inner side and the discharge port is located at an outer circumference is disclosed.

According to the air conditioner of the related art as described above, heat-exchanged air may be evenly discharged in all directions (360°) in the room through the ring-shaped integrated discharge port.

However, the circular air conditioner has shortcomings in that it is not each to control an air flow at a corner portion of the discharge port.

In addition, during the heating operation, performance of the air conditioner is degraded due to an influence of a short circuit that a weakly spreading flow is re-absorbed at the corner of the discharge port.

DISCLOSURE

Technical Problem

In order to solve the problems of the related art as described above, the present disclosure provides an air guide and a ceiling-type air conditioner having the same, capable of preventing an air returning phenomenon that a discharged air flow is intaken back and solving a problem of a degradation of performance due to return air.

The present disclosure also provides an air guide and a ceiling-type air conditioner having the same, capable of maintaining an air volume discharged through a discharge port at a maximum level, regardless of whether or not the air guide is mounted.

The present disclosure also provides an air guide which may be simply inserted into a discharge port and may be separated after installation only when necessary, and a ceiling-type air conditioner having the same.

The present disclosure also provides an air guide and a ceiling-type air conditioner having the same which can be easily manufactured and mounted.

The present disclosure also provides an air guide and a ceiling-type air conditioner having the same, capable of detecting by a sensor that an indoor temperature reaches a set temperature due to a temperature of return air during a heating operation and reducing the number of times an operation stoppage (thermo-off) is entered, thereby increasing the user's comfort.

The present disclosure also provides an air guide and a ceiling-type air conditioner having the same, capable of strengthening a horizontal air flow for wide cooling, strengthening a vertical air flow for intensive heating, and forming a swing air flow as necessary.

The present disclosure also provides an air guide which is applicable even to an air conditioner without an air guide part such as a vane or the like, and a ceiling-type air conditioner having the same.

Technical Solution

To solve the technical problem as described above, there is provided an air guide which is applied to a ceiling-type air conditioner including an indoor unit having a built-in heat exchanger and a built-in blower and comprising a plurality of blowing passages configured to discharge air which passes through the heat exchanger to the outside, and a discharge panel comprising a plurality of inlets receiving the air discharged through the plurality of blowing passages, an inner space configured to at least partially communicate with the plurality of inlets, and a ring-shaped or arc-shaped opening configured to discharge, to a room, air which flows into the inner space, wherein the air guide includes at least two partitions formed to be parallel to a radial direction of the opening and partitioning the inner space of the discharge panel in a circumferential direction; and a curved portion connecting the at least two partitions and having an arc shape, wherein the air guide is detachably inserted into the inside of the opening from the outside of the opening.

The inner space of the discharge panel may include a flow region configured to communicate with each inlet and allow air which flows through the inlet to flow therein, the opening may include a first opening region corresponding to the flow region and a second opening region corresponding to the blocking region, and the curved portion may be mounted such that at least a portion thereof goes by way of the blocking region.

The curved portion may be rotatably connected to the partition.

To solve the technical problem as described above, there is also provided a ceiling-type air conditioner including: an indoor unit having a built-in heat exchanger and a built-in blower and comprising a plurality of openings configured to discharge air which passes through the heat exchanger to the outside; a discharge panel having a ring-shaped discharge port configured to discharge, to a room, the air discharged through the plurality of openings; and an air guide mounted from an outer side of the discharge port so as to be detachable from the discharge port and having the configuration described above.

Advantageous Effect

According to the present disclosure as described above, an air returning phenomenon that a discharged air flow is intaken back may be prevented and a degradation of performance due to return air may be prevented.

In addition, an air volume discharged through a discharge port may be maintained at a maximum level, regardless of whether or not the air guide is mounted.

In addition, the air guide may be simply inserted into the discharge port and may be separated after installation only when necessary.

In addition, the air guide and the ceiling-type air conditioner may be easily manufactured and mounted.

In addition, when the sensor detects that an indoor temperature reaches a set temperature due to a temperature of return air during a heating operation, the number of times an operation stoppage (thermo-off) is entered is reduced, thereby increasing the user's comfort.

In addition, a horizontal air flow for wide cooling may be strengthened, a vertical air flow for intensive heating may be strengthened, and a swing air flow may be formed, as necessary.

In addition, the air guide is applicable even to an air conditioner without an air guide part such as a vane or the like.

MODE FOR INVENTION

Hereinafter, specific embodiments of the present disclosure will be described in detail with reference to the accompanying drawings. However, the spirit of the present disclosure is not limited to the embodiments set forth below, and those skilled in the art who understand the spirit of the present disclosure may easily implement other embodiments that fall within the scope of the same spirit by supplementing, modifying, deleting, adding components, but will also be included within the scope of the present disclosure.

The drawings attached to the following embodiments may be expressed differently from each other in fine parts in the embodiments of the same concept without departing from the spirit of the invention, and specific parts may not be displayed according to the drawings or may be exaggerated according to the drawings.

Figure 1:
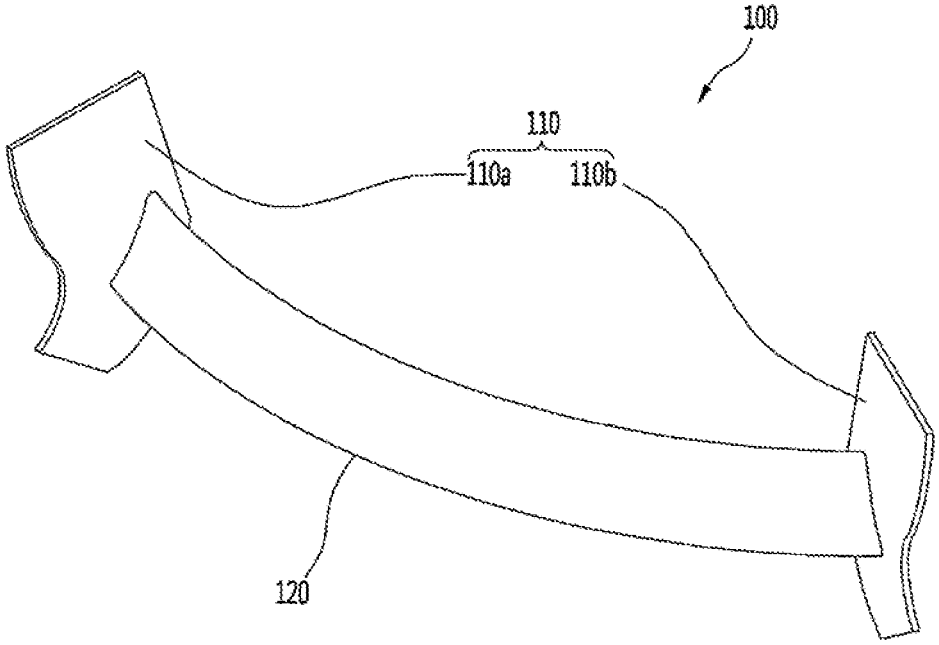
FIG. 1 is a perspective view of an air guide for a ceiling-type air conditioner according to an embodiment of the present disclosure.
Figure 2:
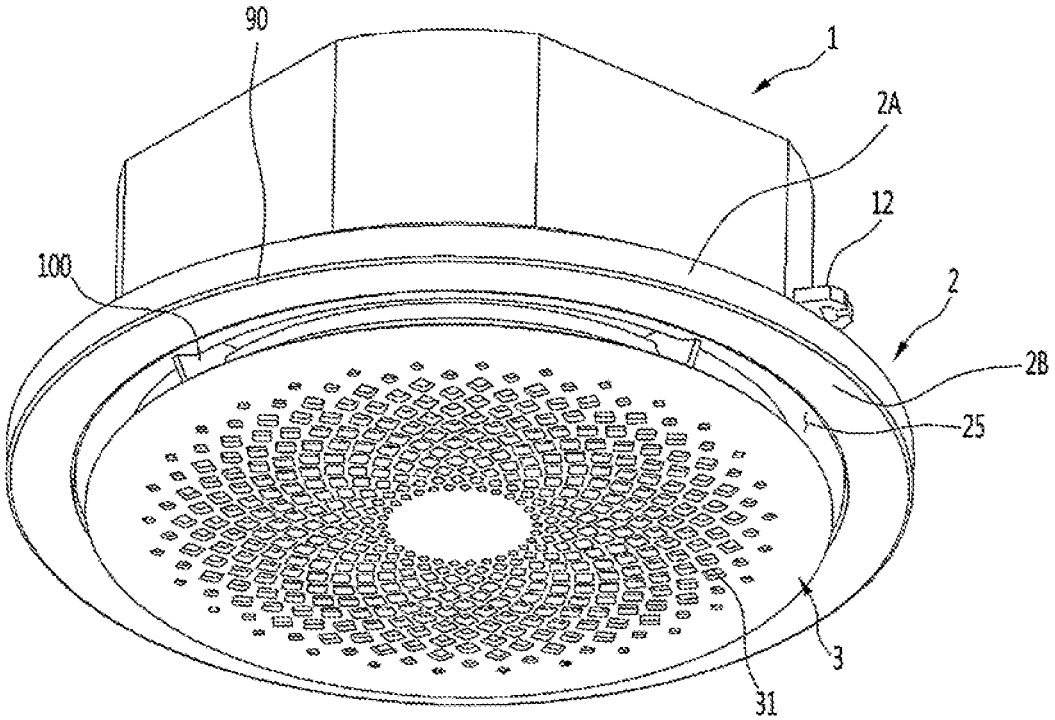
FIGS. 2 and 3 are perspective views showing a ceiling air conditioner equipped with an air guide.
Figure 3:
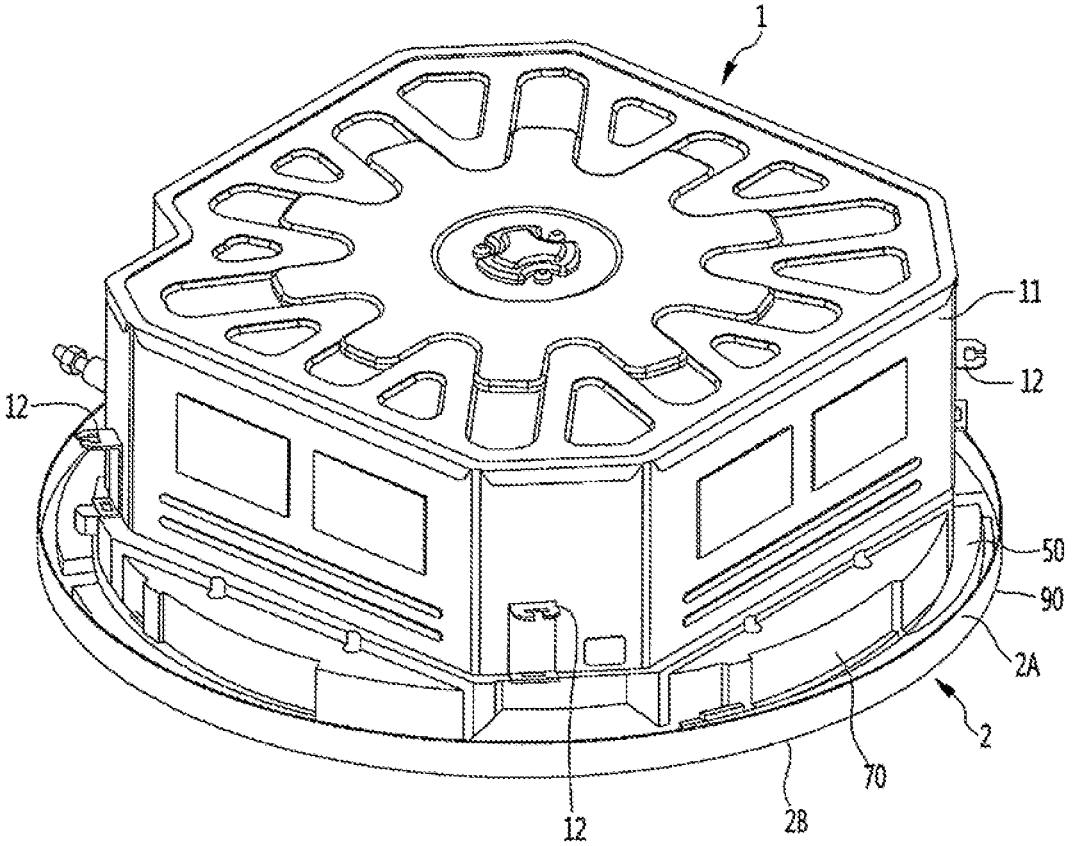
Figure 4:
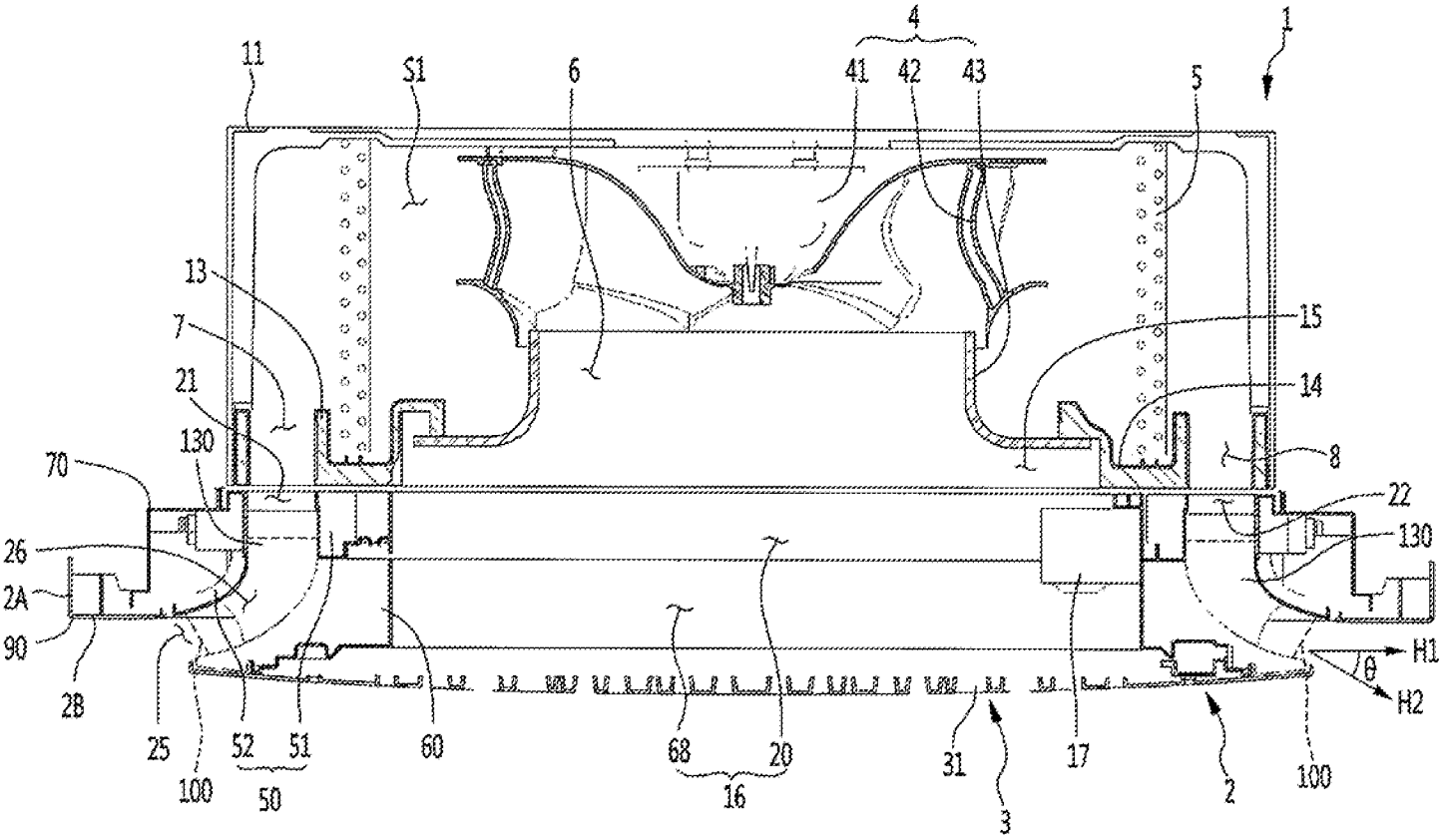
FIG. 4 is a longitudinal sectional view of a ceiling air conditioner equipped with an air guide.

FIG. 1 is a perspective view of an air guide for a ceiling-type air conditioner according to an embodiment of the present disclosure, FIGS. 2 to 3 are perspective views showing a ceiling-type air conditioner equipped with an air guide, and FIG. 4 is a longitudinal sectional view of a ceiling-type air conditioner equipped with an air guide.

Referring to FIGS. 1 to 4, the ceiling-type air conditioner according to the present disclosure are equipped with a blower 4 and a heat exchanger 5 and includes an indoor unit 1 including a plurality of blowing passages 7, 8, 9, and 10 discharging air passing through the heat exchanger to the outside, a plurality of inlets 21, 22, 23, and 24 receiving air discharged through the plurality of blowing passages 7, 8, 9, and 10, an inner space 26 at least partially communicating with the plurality of inlets 21, 22, 23, and 24, and a discharge panel 2 having a ring-shaped or an arc-shaped opening 25 discharging air flowing into the inner space 26 to a room.

In addition, the air guide 100 according to the present disclosure includes at least two partitions 110 formed to be parallel to a radial direction of the opening 25 and partitioning the inner space 26 of the discharge panel 2 in a circumferential direction and a curved portion 120 connecting the at least two partitions 110 and having an arc shape.

In addition, the air guide 100 configured as described above may be detachably inserted into the opening 25 from the outside of the opening 25.

Hereinafter, the ceiling-type air conditioner according to the present disclosure will be described first.

Referring to FIGS. 2 to 4, an indoor unit 1 may include a blower 4 and a heat exchanger 5.

Accordingly, the indoor unit 1 may intake indoor air through the blower 4, heat-exchange the air with the heat exchanger 5, and then blow the air into the discharge panel 2 to supply the air to a room.

The indoor unit 1 may further include an indoor unit flow path body 13 partitioning a region 15 through which air is intaken into the indoor unit 1 and regions 7, 8, 9, and 10 through which air inside the indoor unit 1 is blown to the discharge panel 2.

The Indoor unit 1 may further include a drain unit 14 disposed below the heat exchanger 5.

An inner intake 6 through which the air intaken through a circular intaking panel 3 provided at a central portion of the discharge panel 2 is intaken into the indoor unit 1 may be formed at the indoor unit 1. In addition, a plurality of blowing passages 7, 8, 9, and 10 discharging and guiding air passing through the heat exchanger 5 may be formed at the indoor unit 1.

The indoor unit 1 may discharge air in a downward direction through the plurality of blowing passages 7, 8, 9, and 10. The indoor unit 1 may form a plurality of discharge air flows blown in the downward direction in the interior of the indoor unit 1.

An outer circumference of the indoor unit 1 may have a polygonal shape. The plurality of blowing passages 7, 8, 9, and 10 may be formed to be open in an up-down direction on the bottom of the indoor unit 1.

The indoor unit 1 may discharge a plurality of vertical air flows blown in the downward direction through a bottom surface thereof.

The indoor unit 1 may be installed to be hung on the ceiling. The indoor unit 1 may be supported by fastening members such as anchor bolts fixed to the ceiling. The indoor unit 1 may have a fastening portion 12 to which a fastening member is fastened.

The indoor unit 1 may include a chassis 11 forming an appearance. The chassis 11 may be an indoor unit body forming the appearance of the indoor unit.

The chassis 11 may be mounted at the ceiling by a fastening member such as an anchor bolt.

The chassis 11 may include a combination of a plurality of members. The chassis 11 may have a polyhedral shape in which a bottom surface is open and a space is formed therein.

The chassis 11 may have a space in which the blower 4 and the heat exchanger 5 are accommodated. The chassis 11 may have a shape in which four sides forming front, rear, left, and right surfaces and an upper surface are blocked, and a bottom surface of the chassis 11 may be open.

The blower 4 may be mounted in the chassis 11. Specifically, the blower 4 may be mounted on an upper plate of the chassis.

The blower 4 may be mounted such that at least a portion thereof is positioned in the heat exchanger 5.

The blower 4 may be mounted to be located above the discharge panel 2.

The blower 4 may be configured as a centrifugal blower that intakes air below and blows the air in a centrifugal direction. The blower 4 may include a motor 41 and a centrifugal fan 42 connected to the motor 41. The blower 4 may include an orifice 43 for guiding a flow of air intaken into the centrifugal fan 42.

The motor 41 may be mounted such that a rotary shaft connected to the centrifugal fan 42 protrudes downward. For example, the centrifugal fan 42 may be configured as a turbo fan.

The orifice 43 may be installed to be located inside the chassis 11. The orifice 43 may be installed at the indoor unit flow path body 13. An inner intake 6 may be formed at the orifice 4

Air passing through the intake panel 3 may be intaken into the centrifugal fan 42 through the inner intake 6 of the orifice 43 and blow in the centrifugal direction of the centrifugal fan 42 by the centrifugal fan 42.

The air blown from the centrifugal fan 42 in the centrifugal direction may flow to the heat exchanger 5 arranged to surround the outer circumference of the centrifugal fan 42 and may exchange heat with the heat exchanger 5.

The heat exchanger 5 may be bent at least once. The heat exchanger 5 may be smaller than the chassis 11 and disposed inside the chassis 11.

The heat exchanger 5 may be disposed in a quadrangular shape or a hollow cylindrical shape inside the chassis 11.

The heat exchanger 5 may be spaced apart from an inner surface of the chassis 11. A space in which air communicates with the blowing passages 7, 8, 9, and 10 (to be described later) may be formed between the heat exchanger 5 and the inner surface of the chassis 11.

The heat exchanger 5 may be bent to form a space S1 in which the blower 4 is accommodated. The heat exchanger 5 may include four heat exchanging parts facing different sides of the chassis 11. The heat exchanger 5 may be disposed to surround an outer circumferential surface of the blower 4 on the outside of the blower 4.

An upper surface of the drain unit 14 may be formed to be open, and a space in which a lower portion of the heat exchanger 5 is accommodated may be formed therein.

The indoor unit flow path body 13 may be coupled to the drain unit 14. The indoor unit flow path body 13 may have a hollow portion 15 through which air may pass in an up-down direction. The hollow portion 15 may be an indoor unit air intake through which air from a lower portion of the indoor unit 1 is intaken into the indoor unit 1.

The indoor unit flow path body 13 may be disposed at an inner lower portion of the chassis 11. The indoor unit flow path body 13 may form the bottom appearance of the indoor unit 1.

Figure 5:
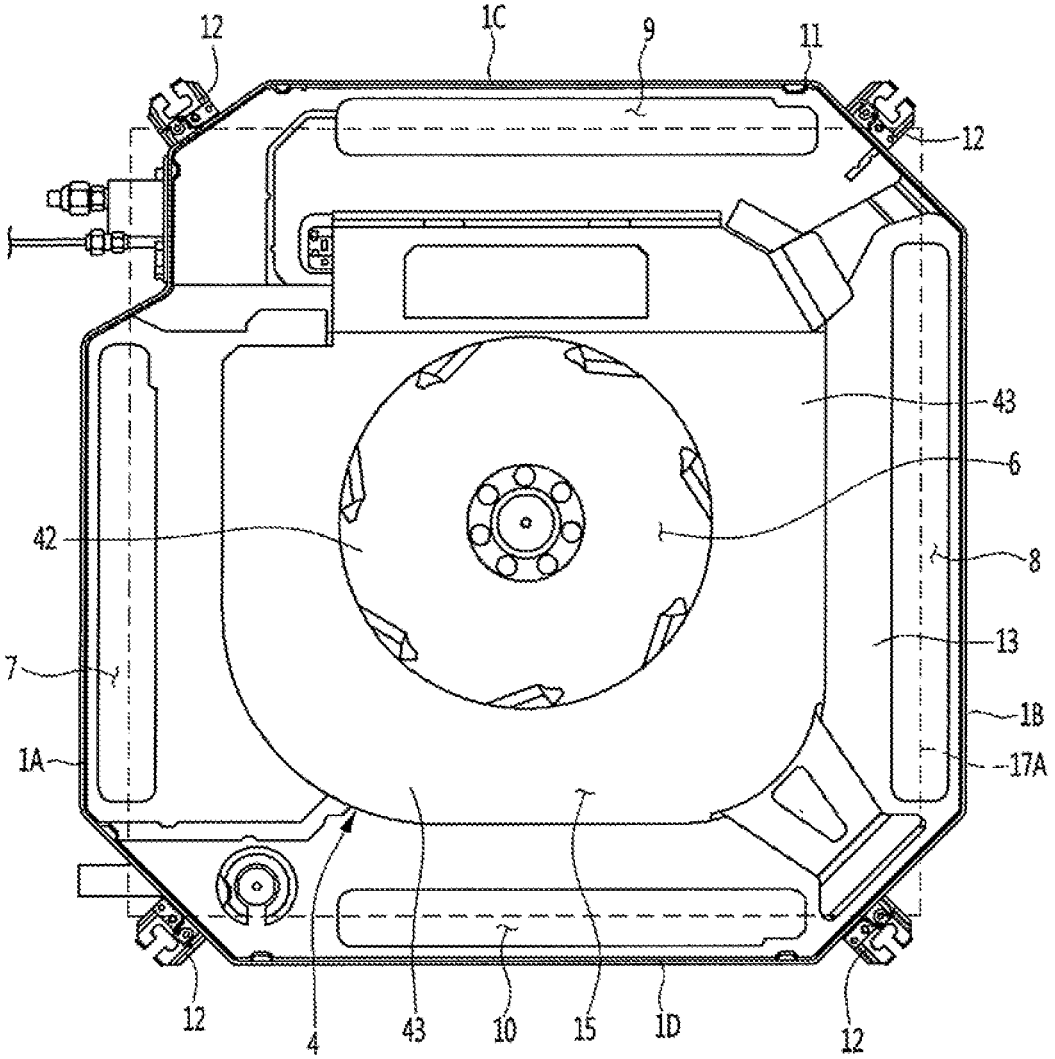
FIG. 5 is a bottom view of an indoor unit which is a part of the present disclosure.

FIG. 5 is a bottom view of an indoor unit which is a part of the present disclosure.

Referring to FIG. 5, each of the plurality of blowing passages 7, 8, 9, and 10 formed in the indoor unit 1 may have a polygonal cross-sectional shape. Each of the plurality of blowing passages 7, 8, 9, and 10 may have a quadrangular cross-sectional shape.

The plurality of blowing passages 7, 8, 9, and 10 may be regions in which air inside the indoor unit 1 is blown to the discharge panel 2.

The plurality of blowing passages 7, 8, 9, and 10 may be formed to be spaced apart from the inner intake 6.

The plurality of blowing passages 7, 8, 9, and 10 may include a left blowing passage 7, a right blowing passage 8, and a front blowing passage 9 and a rear blowing passage 10.

For example, the plurality of blowing passages 7, 8, 9, and 10 may be formed along a quadrangular virtual line 17A (see FIG. 5) and the plurality of blowing passages 7, 8, 9, and 10 may be formed on the surfaces of the quadrangular virtual line 17A, respectively.

The plurality of blowing passages 7, 8, 9, and 10 may be spaced apart from each other at the indoor unit flow path body 13.

The plurality of blowing passages 7, 8, 9, and 10 may be formed between the indoor unit flow path body 13 and the inner surface of the chassis 11. The plurality of blowing passages 7, 8, 9, and 10 may be spaced apart from each other between the indoor unit flow path body 13 and the inner surface of the chassis 11.

The plurality of blowing passages 7, 8, 9, and 10 may be four opening regions different in positions and parallel to each other in opening directions, and the indoor unit 1 may be formed to discharge air heat-exchanged through the plurality of blowing passages 7, 8, 9, and 10 toward the discharge panel 2.

For example, the indoor unit 1 may be a 4-way discharge type indoor unit that forms four vertical air flows parallel to each other in discharge directions.

Referring back to FIGS. 2 to 4, the discharge panel 2 may have a circular outer circumference 2A. The discharge panel 2 may have a flat bottom surface 2B.

The discharge panel 2 may be coupled to the indoor unit 1 and discharge air passing through the plurality of blowing passages 7, 8, 9, and 10 to the outside. The discharge panel 2 may be disposed below the indoor unit 1 together with the intake panel 3.

The discharge panel 2 may be coupled to a lower portion of the indoor unit 1 and guide discharge of the air blown in a downward direction through the plurality of blowing passages 7, 8, 9, and 10 into the room.

The discharge panel 2 may receive air blown in four directions parallel to each other in the indoor unit 1 and discharge and guide the air to the lower perimeter of the discharge panel 2.

As shown in FIG. 4, the discharge panel 2 may change a flow of air blown in a vertical direction, in particular, in a downward direction, from the indoor unit 1 into a horizontal direction H1 to discharge the air or may change the flow of air into a lower inclination direction H2 having an acute angle θ of inclination to discharge the air.

Figure 6:
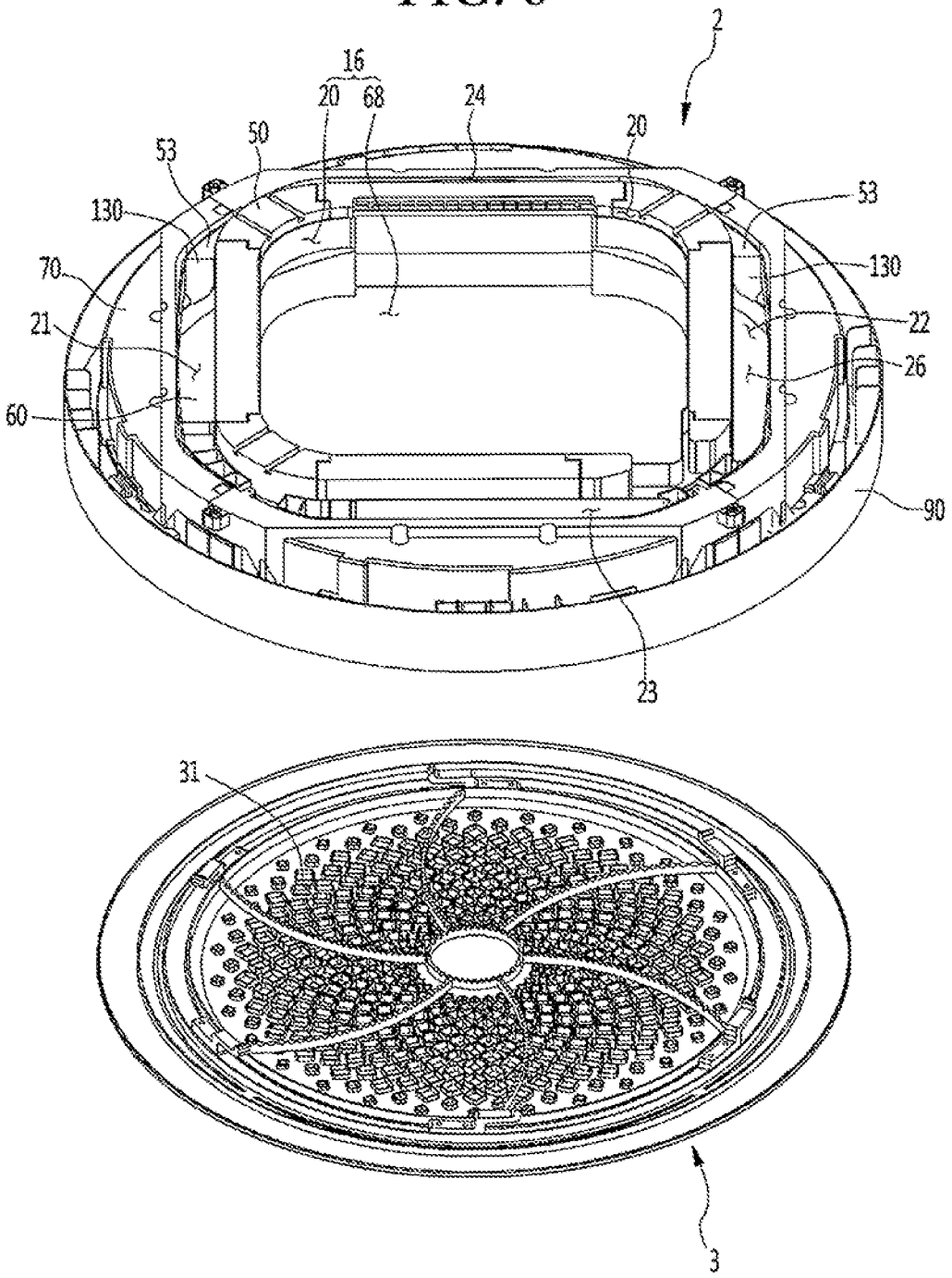
FIG. 6 is an exploded perspective view of a discharge panel and a intaking panel which are a part of the present disclosure.

FIG. 6 is a perspective of a separated discharge panel and an intake panel which are components of the present disclosure.

Referring to FIG. 6, the discharge panel 2 may include a combination of a plurality of members 50, 60, 70, and 90.

At least one inlet 21, 22, 23, and 24 communicating with the plurality of blowing passages 7, 8, 9, and 10 of the indoor unit 1 may be provided at the discharge panel 2. In addition, the discharge panel 2 may have an opening 25 having a circular or arc shape.

An inner space 26 may be provided at the discharge panel 2, and the inner space 26 may communicate with the inlets 21, 22, 23, and 24, and the opening 25. This will be described in detail later.

Figure 7:
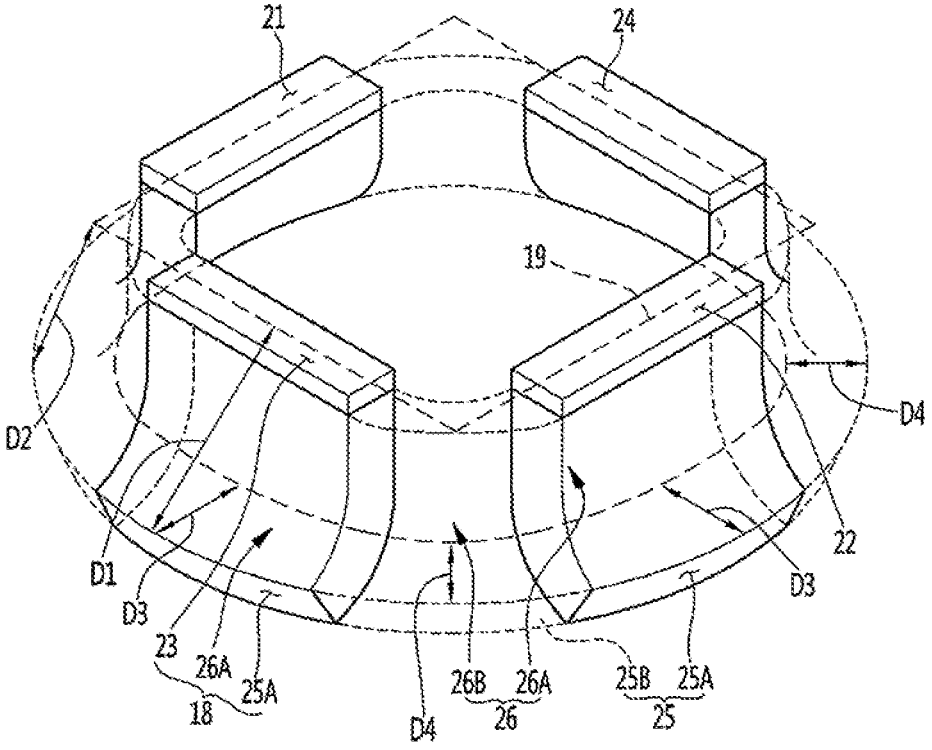
FIG. 7 is a perspective view illustrating a concept of a discharge flow path provided at a discharge panel which is a part of the present disclosure.

FIG. 7 is a perspective view showing a concept of a discharge flow path provided at a discharge panel which is a part of the present disclosure.

Referring to FIGS. 6 and 7, an intake flow path 16 may be provided at the discharge panel 2 to intake and guide the air passing through the intake panel 3 into the indoor unit 1. In addition, a discharge flow path 18 may be provided at the discharge panel 2 to guide and discharge air discharged from the plurality of blowing passages 7, 8, 9, and 10 into the room.

The discharge panel 2 may be provided with an intake flow path 16 may be formed to guide air passing through the intake panel 3 to the hollow portion 15 (see FIG. 5) of the indoor unit 1.

The discharge panel 2 may have a hollow portion through which air passing through the intake panel 3 passes to be intaken into the indoor unit 1. The hollow portion of the discharge panel 2 may be formed to penetrate in an up-down direction at the center of the discharge panel 2. The hollow portion may be the intake flow path 16 of the discharge panel 2. Hereinafter, the intake flow path of the discharge panel 2 and the hollow portion of the discharge panel 2 will be described using the same reference numeral '16'.

The intake flow path 16 may be located on an inner side than the discharge flow path 18 and may be formed to be distinguished from the discharge flow path 18.

The intake flow path 16 may be formed at each of the main flow path body 50 and the inner flow path body 60. The upper hollow portion 20 formed at the main flow path body 50 and the lower hollow portion 68 formed at the inner flow path body 60 may communicate with each other in an up-down direction to form the intake flow path 16.

The ceiling-type air conditioner may accommodate an electrical component 17 such as a sensor, a motor, a printed circuit board (PCB), and the like in the intake flow path 16. In this case, the electrical component 17 may have a quadrangular shape and may be disposed not to interfere with an air flow in the intake flow path 16 having a shape close to a quadrangular shape as much as possible.

Referring back to FIGS. 5 to 7, at least one inlet may be formed at the discharge panel 2. The discharge panel 2 may have a plurality of inlets 21, 22, 23, and 24 corresponding to the plurality of blowing passages 7, 8, 9, and 10. The discharge panel 2 may have an opening 25 having an arc shape or a circular shape. The discharge panel 2 may have an inner space 26 connecting the plurality of inlets 21, 22, 23, and 24, and the opening 25.

The discharge flow path 18 of the discharge panel 2 may include a plurality of inlets 21, 22, 23, and 24, a flow region 26A of the inner space 26, and a first opening region 25A of the opening 25.

The air discharged from the blowing passages 7, 8, 9, and 10 of the indoor unit 1 may flow into the flow region 26A through the plurality of inlets 21, 22, 23, and 24. The air passing through the flow region 26A may be discharged to the outside of the discharge panel 2 through the first opening region 25A.

The inlets 21, 22, 23, and 24 formed at the discharge panel 2 may be located at positions corresponding to the blowing passages 7, 8, 9, and 10 formed at the indoor unit 1.

The inlets 21, 22, 23, and 24 formed at the discharge panel 2 may include a left inlet 21 communicating with a left blowing passage 7 in an up-down direction, a right blowing passage 8 communicating with the right blowing passage 8 in the up-down direction, a front inlet 23 communicating with the front blowing passage 8 in the up-down direction, and a rear inlet 24 communicating with the rear blowing passage 10 in the up-down direction.

A cross-sectional size of each of the plurality of inlets 21, 22, 23, and 24 may be equal to a cross-sectional size of each of the plurality of blowing passages 7, 8, 9, and 10.

The cross-sectional shape of the inlets 21, 22, 23, and 24 may be polygonal. Here, the polygonal shape of the inlets 21, 22, 23, and 24 may include a shape in which at least one vertex portion is rounded to have a predetermined curvature.

The cross-sectional shape of the inlets 21, 22, 23, and 24 may be quadrangular, in particular, rectangular, like the cross-sectional shape of the blowing passages 7, 8, 9, and 10.

The plurality of inlets 21, 22, 23, and 24 may be formed along a quadrangular virtual line 19 (see FIG. 7) like the blowing passages 7, 8, 9, and 10 of the indoor unit 1 and the plurality of inlets 21, 22, 23, and 24 may be formed on the sides of the quadrangular virtual line 19, respectively.

The quadrangular virtual line 19 of the discharge panel 2 illustrated in FIG. 7 and the quadrangular virtual line 17A of the indoor unit 1 illustrated in FIG. 5 have the same size and match in the up-down direction.

The opening 25 may be an air discharge port through which air which passing through the heat exchanger 5 in the ceiling-type air conditioner is discharged to the outside of the ceiling-type air conditioner. At least a portion of the opening 25 may discharge air heat-exchanged in the heat exchanger 5 of the indoor unit 1.

The number of the openings 25 may be smaller than the inlets 21, 22, 23, and 24. The opening 25 may be larger than each of the plurality of inlets 21, 22, 23, and 24.

The opening 25 may have an arc shape. In this case, a plurality of openings may be formed at the discharge panel 2. When the openings 25 have an arc shape, the plurality of openings 25 may be spaced apart from each other in a circumferential direction of the discharge panel 2 and may be formed along a circular virtual line.

The opening 25 may have a circular ring shape. In this case, one opening 25 may be formed in the discharge panel 2. In this case, when the opening 25 is circular, the circular shape may refer to an elliptic shape, and the cross-sectional shape may be formed in a closed loop shape.

The opening 25 may be an outlet through which air passing through the inner space 26 is discharged to the outside of the discharge panel 2.

The discharge panel 2, in a state of being coupled to the lower portion of the indoor unit 1, may be exposed to the room and the opening 25 may be exposed to the room together with the bottom surface of the discharge panel 2.

Referring to FIG. 7, the opening 25 may include a first opening region 25A and a second opening region 25B.

The first opening region 25A may be a region corresponding to the inlets 21, 22, 23, and 24 of the opening 25. Specifically, the first opening region 25A may refer to a region located below the inlets 21, 22, 23, and 24 of the opening 25.

The second opening region 25B may be a region corresponding to between a pair of inlets adjacent to each other among the openings 25. Specifically, the second opening region 25B may refer to a region located below and between a pair of inlets adjacent to each other among the openings 25.

That is, the first opening region 25A may correspond to the inlets 21, 22, 23, and 24 along the direction of the inner space 26, and the second opening region 25B may correspond between the inlets 21, 22, 23, and 24 along the direction of the inner space 26.

The first opening 25A and the second opening 258 may be alternately located along the circumferential direction of the discharge panel 2. When the openings 25 are circular, the first opening regions 25A and the second opening regions 258 may be alternately located along the circumferential direction of the opening 25.

The second opening region 258 may be located between a pair of first opening regions 25A adjacent to each other, and the first opening region 25A may be located between a pair of second opening regions 25B adjacent to each other.

Air flowing from the inlets 21, 22, 23, and 24 corresponding to first opening region 25A may be discharged from the first opening region 25A. Meanwhile, air may not be discharged from the second opening region 25B.

In another example, a portion of the air discharged to the first opening region 25A may also be discharged to the second opening region 25B.

The number of each of the first opening regions 25A and the second opening regions 25B may be equal to the number of the inlets 21, 22, 23, and 24.

Each of the first and second opening regions 25A and 25B may have an arc shape. When the opening 25 has a circular shape, each of the first opening region 25A and the second opening region 25B may have an arc shape forming a portion of the circular shape.

A circumferential length of the first opening 25A may be longer than a circumferential length of the second opening 258. That is, an area of the first opening region 25A may be larger than an area of the second opening region 25B.

Referring back to FIG. 7, the inner space 26 may communicate with the inlets 21, 22, 23, and 24 and the opening 25. The inner space 26 may be located between the inlets 21, 22, 23, and 24 and the opening 25.

The flow region 26A of the inner space 26 may guide air introduced into the inlets 21, 22, 23, and 24 to the opening 25.

In the inner space 26, the flow region 26A may be an air flow change/discharge passage switching an air flow of the air intaken to the plurality of inlets 21, 22, 23, and 24 and guiding the air to the opening 25.

The inner space 26 may have a horizontal cross-section in a closed loop shape.

The inner space 26 may be formed in a shape in which the cross-sectional area gradually increases in a downward direction.

The inner space 26 may be formed to switch a vertical air flow to a horizontal air flow, and to this end, a vertical cross-sectional shape thereof may be a curved shape. The inner space 26 may have a shape in which the vertical cross-sectional shape opens in an outward direction toward the lower side.

Also, a quadrangular imaginary line 19 in which the plurality of inlets 21, 22, 23, and 24 are located is not only higher in position than the opening 25 but also smaller than the opening 25. In this case, a first distance D1 between the side of the quadrangular virtual line 19 and the opening 25 may be different from a second distance D2 between the vertex of the quadrangular virtual line 19 and the opening 25.

Specifically, the first distance D1 may be longer than the second distance D2, and the distance between the quadrangular virtual line 19 and the circular opening 25 may be increased and decreased along the circumferential direction. The first distance D1 may gradually decrease toward the vertex of the quadrangular virtual line 19.

The inner space 26 may be formed such that horizontal widths D3 and D4 are not equal in the circumferential direction in consideration of the difference between the distances D1 and D2.

The horizontal widths D3 and D4 of the inner space 26 may alternately increase and decrease along the opening 25 and may increase and decrease repeatedly.

The inner space 26 may include a flow region 26A and a blocking region 268.

Specifically, the flow region 26A may be formed below the inlets 21, 22, 23, and 24, and the blocking region 26B may be formed below the perimeter of the inlets 21, 22, 23, and 24 according to a position relation with the inlets 21, 22, 23, and 24.

The blocking region 268 may be located below between a pair of inlets adjacent to each other.

The flow region 26A and the blocking region 26B may be partitioned by the barrier 130 (to be described later). The barrier 130 may be disposed between the flow region 26A and the blocking region 26B.

The flow region 26A may be located between a pair of barriers 130 facing each other.

The blocking region 268 may be located on both sides of the flow region 26A in the circumferential direction and formed at a corner portion between the flow regions 26A.

The flow region 26A and the blocking region 26B may be alternately located along the circumferential direction of the discharge panel 2.

Referring back to FIG. 7, the first opening region 25A may be located below the flow region 26A. Also, a second opening region 25B may be located below the blocking region 26B.

The flow region 26A may be located between the inlets 21, 22, 23, and 24, and the first opening region 25A. The blocking region 26B may be located between a portion between the pair of inlets adjacent to each other and the second opening region 25B.

Also, the horizontal width D3 of the flow region 26A may be larger than the horizontal width D4 of the blocking region 26B. Here, the comparison between the horizontal widths D3 and D4 is made at the same height.

An upper end of the inner space 26 may be a region closer to the plurality of inlets 21, 22, 23, and 24, among the opening 25 and the plurality of inlets 21, 22, 23, and 24.

A lower end of the inner space 26 may be an opening 25 and a cross-sectional shape thereof may be a circular shape. Specifically, the lower end of the flow region 26A may be the first opening region 25A, and the cross-sectional shape thereof may be an arc shape. Further, a lower end of the blocking region 268 may be the second opening region 25B, and a cross-section thereof may have an arc shape.

The inner space 26 may have a cross-sectional shape gradually changed to a shape closer to a circular shape in the downward direction.

When the ceiling-type air conditioner operates, air passing through the plurality of inlets 21, 22, 23, and 24 may be dropped into the flow region 26A and may subsequently be discharged to the room through the first opening region 25A.

Here, the air dropped into the flow region 26A may be blocked by the barrier 130 (to be described later) and may not flow to the blocking region 268, and thus, air may be prevented from being discharged to the second opening region 258.

That is, in the present embodiment, the air flowing into the plurality of inlets 21, 22, 23, and 24 does not spread in the horizontal direction in the inner space 26 and may be discharged to the first opening region 25A of the opening 25.

Figure 8:
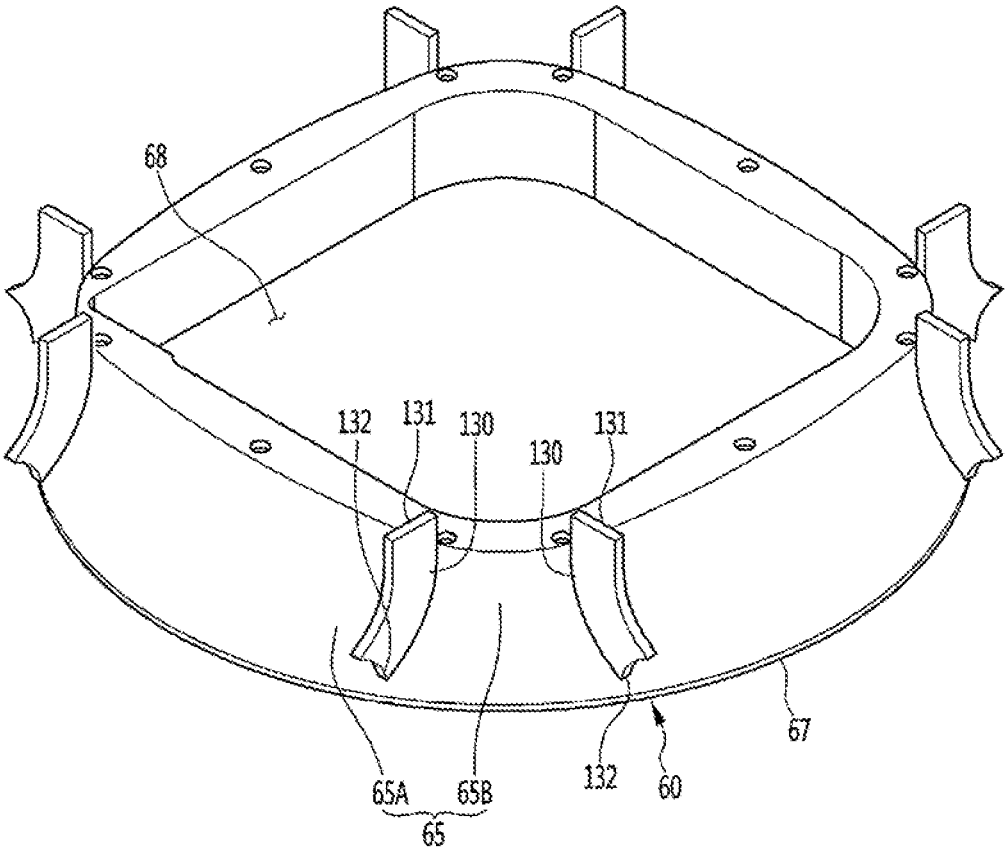
FIG. 8 is a perspective view of an inner flow path body and a barrier which are a part of the present disclosure.

FIG. 8 is a perspective view of an inner flow path body and a barrier which are components of the present disclosure.

Referring to FIGS. 7 and 8, the ceiling-type air conditioner according to an embodiment of the present disclosure may include the barrier 130. The barrier 130 may be disposed in the inner space 26A of the discharge panel 2.

An upper end 131 of the barrier 130 may be located below the inlets 21, 22, 23, and 24 and a lower end 132 may be located above the opening 25. However, the present disclosure is not limited thereto, and the upper end of the barrier 130 may be located at the inlets 21, 22, 23, and 24 and the lower end 131 may be located at the opening 25.

The upper end 131 of the barrier 130 may be formed at the same height as the upper end 26C of the inner space 26. The lower end 132 of the barrier may be located before an end of the opening 25 along an air flow direction.

The barrier 130 may partition the inner space 26 into the flow region 26A and the blocking region 26B. The barrier 130 may be disposed between the flow region 26A and the blocking region 26B.

At least one barrier 130 may be provided. Preferably, the number of barriers 130 may be twice the number of inlets 21, 22, 23, and 24. That is, a pair of barriers 130 may correspond to one inlet. For example, four inlets 21, 22, 23, and 24 may be formed at the discharge panel 2 and eight barriers 130 may be provided.

The barrier 130 may be disposed perpendicular to the inner space 26.

The lower end 132 of the barrier 130 may be concave. Specifically, the lower end 132 of the barrier 130 may be formed concave upward. As a result, the lower end 132 of the barrier 130 may be prevented from being exposed to the outside of the discharge panel 2 and the ceiling-type air conditioner may be improved in terms of design.

At least a portion of the barrier 130 may be located between the inner flow path body 60 and the outer body portion 52. The barrier 130 may be in contact with the inner curved surface 65 which is the outer circumferential surface of the inner flow path body 60.

The barrier 130 may be disposed between the inlet facing surface 65A and the connecting portion facing surface 65B of the outer circumferential surface of the inner flow path body 60. The barrier 130 may be disposed at a boundary between the inlet facing surface 65A and the connecting portion facing surface 658.

The inner end of the barrier 130 may have a shape outwardly bent downward along the outer circumferential surface of the inner flow path body 60.

The lower end 132 of the barrier 130 may be located above the lower end 67 of the inner flow path body 60.

The upper end 131 of the barrier 130 may be located above the upper surface 69 of the inner flow path body 60.

The barrier 130 may be provided in plurality, and each barrier may be spaced apart from each other. The barrier 130 may be disposed along the outer circumferential surface of the inner flow path body 60.

Referring back to FIGS. 4 to 8, the discharge panel 2 may include a main flow path body 50 and an inner flow path body 60 coupled to the main flow path body 50.

In addition, the discharge panel 2 may further include an outer cover 70 for guiding air passing through the blowing passages 7, 8, 9, and 10 to the flow region 26A of the inner space 26. The discharge panel 2 may further include a decor cover 90 coupled to the main flow path body 50.

The main flow path body 50 may include an upper body portion 51, an outer body portion 52, and a connecting portion 53.

The upper body portion 51 may be formed such that the upper hollow portion 20 penetrates in the up-down direction at the center thereof. The upper body portion 51 may be connected to the outer body portion 52 larger than the upper body portion 52 by the connecting portion 53.

The outer body portion 52 may be larger than the upper body portion 51. A height of the outer body portion 52 may be lower than a height of the upper body portion 51.

The connecting portion 53 may connect the upper body portion 51 and the outer body portion 52 having different heights and sizes.

The intake panel 3 may be disposed below the inner flow path body 60. The intake panel 3 may have a plurality of through holes 31 through which air passes to be intaken into the lower hollow portion 68. All or some of the plurality of through holes 31 may be located below the lower hollow portion 68.

Here, the through holes 31 may be air inlets through which indoor air is intaken into the ceiling-type air conditioner.

Hereinafter, an operation example of the ceiling-type air conditioner according to the present disclosure configured as described above will be described.

First, when an operation command is input from a user, the blower 4 and the outdoor unit are driven, and when the blower 4 is driven, air in the room may pass through the intake panel 3 and then pass through the upper hollow portion 20 of the discharge panel 2 and be intaken into the indoor unit 1.

The air intaken into the indoor unit 1 may flow to the heat exchanger 5 outside the blower 4 by the blower 4 and may exchange heat with the heat exchanger 5 while passing through the heat exchanger 5. The air cooled or heated while being heat-exchanged with the heat exchanger 5 may pass through the plurality of blowing passages 7, 8, 9, and 10 and exit the indoor unit 1. Here, a plurality of discharge air flows may be blown in the downward direction through the blowing passages 7, 8, 9, and 10.

The air passing through the plurality of blowing passages 7, 8, 9, and 10 may be transferred to the inlets 21, 22, 23, and 24 of the discharge panel 2 communicating with the blowing passages 7, 8, 9, and 10 in a facing manner and flow to the inner space 26 of the discharge panel 2.

Here, in a first embodiment, if the barrier 130 is not provided, the air flowing through the inlets 21, 22, 23, and 24 may be discharged to the opening 25 through the inner space 26.

In a second embodiment, when the inner space 26 is partitioned into the flow region 26A and the blocking region 26B by the barrier 130, air flowing through the inlets 21, 22, 23, and 24 may flow to the flow region 26A and may not flow to the blocking region 26B due to the barrier 130.

Subsequently, the air flowing through the flow region 26A may be discharged to the first opening region 25A of the opening 25. Meanwhile, air is not discharged from the second opening region 25B of the opening 25.

However, even in the case described above, there is still problem in that part of the air discharged to the first opening region 25A is returned to the second opening region 25B having a relatively low pressure or intaken into the intaking panel 3.

In addition, if the barrier 130 is not provided, there is a problem in that part of the air discharged to the first opening region 25A is returned to the second opening region 25B having a relatively low pressure or intaken into the intaking panel 3.

In order to prevent this, in the present disclosure, the air guide 100 for shielding the whole or at least part of the second opening region 258 is mounted.

When the air guide 100 is mounted as described above, it is possible to prevent the air discharged into the first opening region 25A from being re-intaken into the second opening region 25B. In addition, the problem that the air flow discharged to the first opening region 25A is intaken into the intaking panel 3 may also be solved.

Above all, the air guide 100 according to the present disclosure has an advantage that it may be inserted directly into an already manufactured or installed ceiling-type air conditioner and used.

Hereinafter, the air guide 100 according to the present disclosure will be described in detail.

Referring back to FIGS. 1 and 2, the air guide 100 includes at least two partitions 110*a* and 110*b* partitioning the inner space 26 of the discharge panel 2 in the circumferential direction and a curved portion 120 connecting the at least two partitions 100*a* and 100*b* and having an arc shape, and is detachably inserted into the opening 25 from the outside of the opening 25.

In addition, as described above, the inner space 26 of the discharge panel 2 may include the flow region 26A communicating with the inlets 21, 22, 23, and 24 and the blocking region 268 provided between the inlets 21, 22, 23, and 24 and between the flow regions 26A. The opening 25 may include a first opening region 25A corresponding to the flow region 26A and a second opening region 25B corresponding to the blocking region 268, and the curved portion 120 may be mounted so that at least a portion thereof passes through the blocking region 26B.

That is, a distance between the partitions 110*a* and 110*b* and a length of the curved portion 120 may be equal to the distance between the blocking regions 26B or greater than the distance between the blocking regions 26B.

In addition, there may be various embodiments for the size and mounting position of the partitions 110*a* and 110*b* and the curved portion 120.

For example, the partitions 110*a* and 110*b* may also be mounted at a boundary between the flow region 26A and the blocking region 268.

As another example, the partitions 110*a* and 110*b* may be mounted at the flow region 26A through the first opening region 25A.

As another example, the blocking region 268 may be disposed between the partitions 110*a* and 110*b*.

In addition, as described above, in case where the barrier 130 partitioning the inner space 26 of the discharge panel 2 into the flow region 26A and the blocking region 26B is further provided, the partitions 110*a* and 110*b* may be disposed at positions corresponding to the barrier 130.

In addition, in case where the barrier 130 partitioning the inner space 26 of the discharge panel 2 into the flow zone 26A and the blocking zone 26B is further provided, the barrier 130 may be located between the partitions 110*a* and 110*b*.

That is, the partitions 100*a* and 100*b* are installed at or near the boundary between the first opening region 25A and the second opening region 25B or at or near the boundary between the flow region 26A and the blocking region 26B.

Due to the installation of the partitions 100*a* and 100*b* as described above, the flow region 26A and the blocking region 26B may be reliably partitioned regardless of whether the barrier 130 is mounted. In addition, the first opening region 25A and the second opening region 25B may be reliably partitioned regardless of whether the barrier 130 is mounted.

Therefore, it is possible to prevent the air discharged into the first opening region 25A from being re-intaken into the second opening region 258.

Above all, since the curved portion 120 is connected between the partitions 100*a* and 100*b*, the air discharged to the first opening region 25A is reliably prevented from being re-Intaken into the second opening region 25B.

For example, a curvature of the curved portion 120 may be formed to correspond to a curvature of the opening 25.

The curved portion 120 may block the entire second opening region 25B and may block at least a portion thereof.

In the above description and the following description, the flow region 26A and the blocking region 26B, and the first opening region 25A and the second opening region 25B may be defined regardless of whether the barrier 130 is mounted or not.

In detail, the flow region 26A and the first opening region 25A refer to regions (regions from which heat-exchanged air is discharged) corresponding to the blowing regions 7, 8, 9, and 10 and the inlets 21, 22, 23, and 24, and the blocking region 268 and the second opening region 258 correspond to the space between the blowing regions 7, 8, 9 and 10 and the space between the inlets 21, 22, 23 and 24.

In the present embodiment, the air guide 100 may be installed in proportion to the number of the blocking regions 26B and the second opening regions 258.

Figure 9:
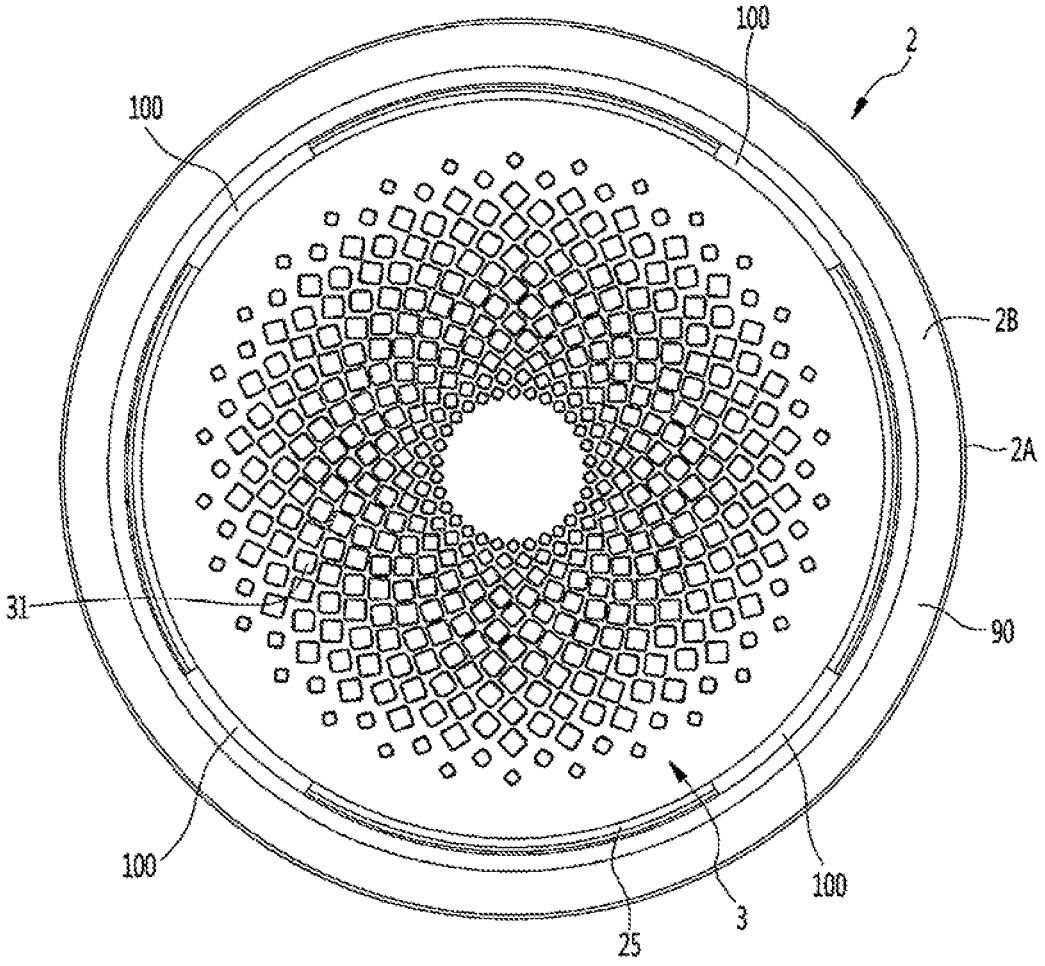
FIG. 9 is a plan view of a ceiling-type air conditioner according to the present disclosure.

FIG. 9 is a plan view of a ceiling-type air conditioner according to the present disclosure.

Referring to FIG. 9, it can be seen that, in the case of an air conditioner in which the blocking regions 26B and the second opening regions 258 are formed at four locations, the air guide 100 is mounted at four locations.

In a modification, the air guide 100 may be mounted at the first opening region 25A.

As described above, when the air guide 100 is mounted at the first opening region 25A, the air guide 100 may switch an air flow of the discharged air.

In particular, a direction and intensity of the discharged air may be adjusted according to a shape of the curved portion 120.

In addition, the curved portion 120 may be rotatably connected to the partition 110.

As described above, when the curved portion 120 rotates about the partition 110, a direction of the air discharged through the opening 25 in which the curved portion 120 is disposed may be adjusted. In addition, when air is discharged from the opening 25 in which the curved portion 120 is disposed, the air may be discharged while forming a swing air flow.

In addition, while rotating the curved portion 120, the entirety or a portion of the opening 25 where the curved portion 120 is disposed may be blocked according to circumstances. That is, the degree of opening of the opening 25 in which the curved portion 120 is disposed may be adjusted.

In addition, the degree of lying down of the curved portion 120 may be adjusted to adjust the air flow discharged from the opening 25. For example, a vertical air flow or a horizontal air flow may be generated according to the degree of lying down of the curved portion 120.

In addition, a driving unit for providing a rotational force to rotate the curved portion 120 may be further provided.

For example, the driving unit may include a motor and a gear.

Accordingly, as the motor rotates, the curved portion 120 connected to a rotary shaft of the motor through the gear may rotate.

In addition, a resistant part may be provided between the curved portion 120 and the partition 110 to reduce a rotational force applied to the curved portion 120. There may be various embodiments within a range that the resistant part is provided between the curved portion 120 and the partition 110 to maintain an angle set by the user, while preventing the curved portion 120 from being arbitrarily rotated by a draft or the like.

As an example, the resistant part may be provided as an oil damper. Here, the curved portion 120 may be connected to a rotary shaft of the resistant part.

When the resistant part is provided as described above, the user may easily adjust the angle of the curved portion 120, while preventing the curved portion 120 from rotating arbitrarily.

That is, the user may freely adjust the angle of the curved portion 120, if necessary, to completely block an inflow of air and further may adjust a discharge angle of the discharged air.

In addition, in a state in which the partition 110 is inserted and fixed in the inner space 26, the curved portion 120 and the partitions 110 may be connected in various known methods within a range in which the curved portion 120 is rotatable.

In addition, the inner space 26 of the discharge panel 2 and the partition 110 inserted into the inner space 26 may have a vertical cross-section in a bent shape.

In detail, the inner space 26 may be bent outward so as to discharge the air flowing from the upper side to the lower side in a horizontal direction or an inclined direction.

In addition, when the inner space 26 and the partition 110 have the bent shape as described above, the partition 110 may be maintained in a state of being inserted in the inner space 26.

Specifically, when the inner space 26 and the partition 110 have the bent shape, the partition 110 may be supported in the horizontal direction in a state in which the partition 110 is received in the inner space 26, and thus, the partition 110 and the curved portion 120 connected to the partition 110 may be maintained in the state of being accommodated in the inner space 26.

In addition, the partition 110 may be easily inserted into the inner space 26 through the opening 25.

Specifically, when the inner space 26 and the partition 110 are formed in a curved shape, the partition 110 may be rotated in the bent direction of the inner space 26 so as to be pushed to be inserted.

In addition, the curved portion 120 may have a vertical cross-section in a bent shape.

Figure 10:
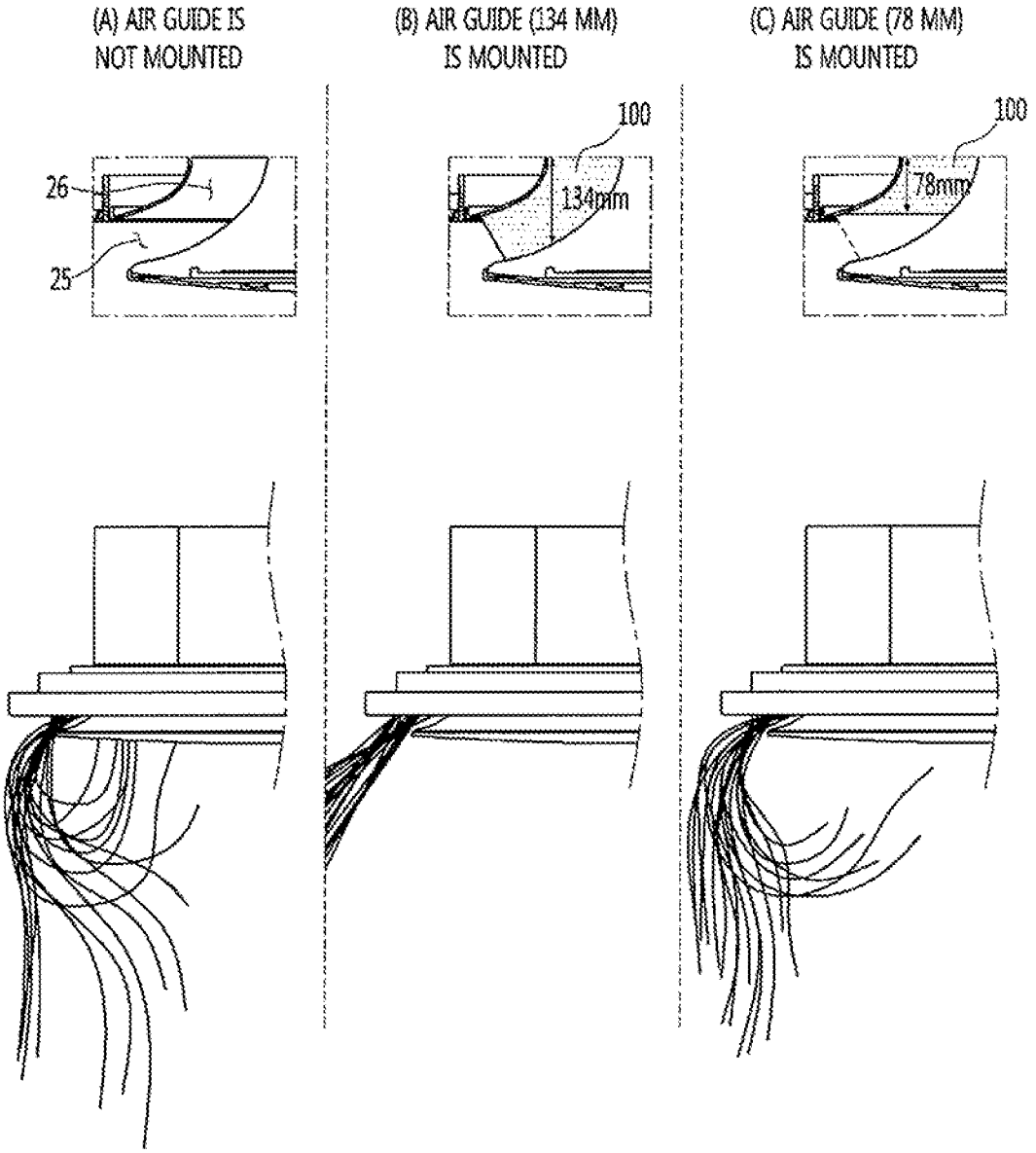
FIG. 10 is a view illustrating a flow analysis result of a discharge air flow depending on whether an air guide is installed.

FIG. 10 is a view showing a flow analysis result of a discharge air flow according to whether the air guide is installed.

Referring to FIG. 10, it can be seen that, when the air guide 100 is not mounted (a in FIG. 10), the air discharged through the opening 25 is returned.

Meanwhile, when the air guide 100 is mounted (b and c of FIG. 10), return of the air discharged through the opening 25 is improved as compared with the case (1 of FIG. 10) where the air guide 100 is not mounted.

In particular, it can be seen that, when the end of the air guide 100 extends to close to the end of the opening 25, return air rarely occurs.

The air guide and the air conditioner having the same according to the present disclosure as described above may prevent the air returning phenomenon that the discharged air is intaken back and solve the problem of a degradation of performance due to return air.

In addition, the air guide may be inserted into the opening in a simple manner, may be separated after installation only if necessary, may be easily manufactured and mounted, and may be applied even to an air conditioner without an air guide part such as vane or the like.

The invention claimed is:

1. An air guide for an air conditioner for a ceiling, the air conditioner including an indoor unit having a built-in heat exchanger and a built-in blower and comprising a plurality of blowing passages configured to discharge air which passes through the heat exchanger to the outside, and a discharge panel comprising a plurality of inlets that receives the air discharged through the plurality of blowing passages, an inner space configured to at least partially communicate with the plurality of inlets, and an opening which is ring-shaped or arc-shaped and configured to discharge, to a room, air which flows into the inner space, the air guide comprising:

at least two partitions configured to partition the inner space of the discharge panel in a circumferential direction; and a curved portion that connects the at least two partitions and having an arc shape, wherein the air guide is configured to be detachably inserted into an inside of the opening of the air conditioner from outside of the opening, wherein the inner space of the discharge panel comprises a plurality of flow regions configured to communicate with each inlet of the plurality of inlets and allow air which flows through the plurality of inlets to flow therein, and a plurality of blocking regions located between the plurality of flow regions, wherein the opening comprises a first opening region corresponding to each of the plurality of flow regions and a second opening region corresponding to each of the plurality of blocking regions, wherein the curved portion is configured to be mounted such that at least a portion thereof is in the blocking region, wherein the at least two partitions are configured to be mounted at boundaries between the plurality of flow regions and the plurality of blocking regions, and wherein each blocking region is disposed between the at least two partitions.

2. The air guide of claim 1, wherein the at least two partitions are mounted through the first opening.

3. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 2.

4. The air guide of claim 1, further comprising:

a plurality of barriers that partitions the inner space of the discharge panel into the plurality of flow regions and the plurality of blocking regions, wherein each partition is disposed at a position corresponding to the barrier.

5. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 4.

6. The air guide of claim 1, further comprising:

a plurality of barriers that partitions the inner space of the discharge panel into the plurality of flow regions and the plurality of blocking regions, wherein each barrier is located between the at least two partitions.

7. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 6.

8. The air guide of claim 1, wherein the inner space of the discharge panel and the at least two partitions inserted into the inner space have a bent shape in a vertical cross-section thereof.

9. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 8.

10. The air guide of claim 1, wherein the curved portion has a bent shape in a vertical cross-section thereof.

11. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 10.

12. An air conditioner for a ceiling, comprising:

an indoor unit having a built-in heat exchanger and a built-in blower and comprising a plurality of openings configured to discharge air which passes through the heat exchanger to the outside;

a discharge panel having a ring-shaped discharge port configured to discharge, to a room, the air discharged through the plurality of openings; and an air guide mounted from an outer side of the discharge port so as to be detachable from the discharge port, wherein the air guide is the air guide of claim 1.

* * * * *